United States Patent [19]

Shultz

[11] Patent Number: 4,599,141

[45] Date of Patent: Jul. 8, 1986

[54] PROCESS FOR THE THERMAL AND CHEMICAL DESTRUCTION OF TOXIC AND INFECTIOUS BIOLOGICAL MATERIALS

[76] Inventor: Clifford G. Shultz, 1701 Glendale, Evansville, Ind. 47712

[21] Appl. No.: 638,501

[22] Filed: Aug. 7, 1984

[51] Int. Cl.[4] ..... C10B 49/14; C10B 57/04

[52] U.S. Cl. ..... 201/2.5; 201/11; 201/25

[58] Field of Search ..... 201/2.5, 11, 25; 48/197 R, 92, 209, 197 A; 210/774; 585/240; 55/72

[56] References Cited

U.S. PATENT DOCUMENTS

| | | | |
|---|---|---|---|
| 2,700,018 | 1/1955 | Gilbert | 201/11 |
| 3,343,911 | 9/1967 | Eisenlohr | 423/495 |
| 3,668,120 | 6/1972 | Patterson | 48/92 |
| 3,770,419 | 11/1973 | Brown | 201/11 |
| 3,970,524 | 7/1976 | Fink | 201/2.5 |
| 4,206,186 | 6/1980 | Hölter et al. | 48/197 R |
| 4,246,255 | 4/1981 | Grantham | 423/210.5 X |
| 4,289,625 | 9/1981 | Tarmen et al. | 48/197 A |
| 4,400,566 | 8/1983 | Colon | 585/359 |
| 4,469,661 | 9/1984 | Shultz | 423/210.5 |

FOREIGN PATENT DOCUMENTS

| | | | |
|---|---|---|---|
| 24250 | 8/1979 | European Pat. Off. | 201/11 |
| 52-57149 | 5/1977 | Japan | 423/DIG. 12 X |

OTHER PUBLICATIONS

Arita, H., Chemical Abstracts, 85:82963h, 1976.

*Primary Examiner*—Peter Kratz

[57] ABSTRACT

A process for the destruction of biological waste products comprises the steps of heating said waste products in a sealed chamber, e.g. at 600° C.–850° C., to volatize volatiles and to pyrolyze non-voltatiles and producing an output stream comprising gas with residual biological matter entrained therein followed by treating said output stream with molten aluminum thereby effecting chemical reduction by reaction with the aluminum and producing innocuous effluent.

5 Claims, 1 Drawing Figure

PROCESS FOR THE THERMAL AND CHEMICAL DESTRUCTION OF TOXIC AND INFECTIOUS BIOLOGICAL MATERIALS

FIELD OF THE INVENTION

This invention relates to a method for pyrolytically and chemically detoxifying and destroying biological waste products, specifically surgical and pathological hospital waste and clinical and biological laboratory waste.

BACKGROUND OF THE INVENTION

Human and veterinary hospitals, surgical clinics, pathology laboratories and associated health care facilities throughout the world are routinely removing and disposing of tissues and body fluids from sick, injured and frequently infected humans and animals. In addition, large volumes of contaminated syringes, tubes, surgical bandages and blood products enter the waste streams of these institutions. In many cases, these materials are harmless and pose no threat of infection to persons who handle or who are otherwise exposed to them. In some cases, however, these materials can contain infective viruses, pathogenic bacteria, toxins and/or bacterial spores which constitute a threat to patients, health care professionals and the general public. In many cases, hospital and clinical waste carries with it a noxious odor and may be considered unsightly.

In addition to the above-mentioned facilities, there are numerous university and medical school facilities in which research into the etiology of disease, experimental therapeutics and basic research is conducted. Fermentation broths and tissue cultures, as well as experimental animals, may frequently contain higher concentrations of rare and pathogenic organisms and toxic and carcinogenic chemical agents than would be found in hospital and clinical wastes. Agricultural research facilities frequently produce mosses, ferns and fungi which reproduce through sporulation and which may be either pathogenic or allergenic.

Recent advances in genetic engineering enable the production of potent pharmaceuticals, toxins, and other biochemicals in large fermentation cultures. Once the desired chemical products have been isolated from the broth, the broth must be properly treated to control both odor and the possibility that potentially infectious agents and toxins may be released into the environment.

The disposal of small amounts of infectious laboratory wastes, bandages and similar contaminated materials has, since the invention of the Chamberland autoclave in 1884, been performed using wet steam. Wet steam is effective against most bacteria and mycotoxins, but is frequently ineffective against spores, toxins and the so-called "slow" viruses. Steam sterilization is extremely energy intensive, must be monitored regularly for effectiveness, usually produces an odiferous product, and results in no dimunition in the size of the waste. The autoclaving of whole research animals and large volumes of tissue is rarely practiced, except in extreme emergencies.

Chemical treatment of pathological waste has never achieved routine use. Chemical treatment of tissues requires the handling of comparatively large volumes of corrosive and toxic chemicals, such as chloride of lime and formaldehyde. The end result is an increased volume of a sterile, albeit chemically hazardous, waste.

The incineration of whole bodies, parts thereof and tissues has been a routine procedure at medical facilities, morgues, mortuaries and veterinary hospitals. Incineration involves minimum transportation within and especially outside of the institution, produces a small volume of essentially sterile waste, and is comparatively energy efficient. Since the passage of the Hill-Burton Act, all hospitals constructed using federal funds have been required to install a pathological incinerator. Air quality regulations emanating from Federal Environmental Protection Agency and from state equivalents place limits upon the visible emissions from such incinerators. Because retrofitting of this equipment frequently entails major design changes, particularly with older equipment, many of these incinerators have been phased out. The use of small, pathological incinerators for the disposal of laboratory wastes and patient contact items is limited by the design of a pathological incinerator, which is typically a small solid hearth, single chamber unit. The incineration of significant volumes of plastic laboratory items such as petri dishes and syringes results in the emmission of large quantities of black smoke, and the BTU content of these items frequently causes dramatic changes in combustion chamber temperatures. The incorporation of tissue and infectious waste into the general waste stream of an institution has been attempted at several large medical institutions, but entails the installation of new and complex incinerators and the hiring of additional, qualified operators, and is frequently beyond the financial capabilities of small and medium sized hospitals.

There exists, therefore, a need for a device capable of destroying pathogenic organisms, spores and viruses, as well as the tissues and laboratory equipment in which they are contained, which device is capable of significantly reducing the volume of waste while producing gaseous and particulate emissions of low toxicity or which are easily trapped or otherwise contained. The device should be amenable to production in sizes suitable for installation in facilities zoned for light industry and require minimum operator training and service. Finally, the cost of construction and operation must be competitive with other, less efficient, methods of disposal.

SUMMARY OF THE INVENTION

This invention provides a process for the destruction of toxic and infectious biological waste products, e.g. human or animal tissues, biological fluids such as blood, and bandages, cultures and combustible laboratory apparatus containing infectious bacteria, bacterial spores, toxins and viruses, as well as pharmaceuticals and other trace chemicals which may be included therein.

This process comprises the steps of: (a) heating said waste products in a sealed chamber, e.g. a solid hearth, gas-tight vessel, to vaporize volatile materials and pyrolyze non-volatiles, thereby producing an output stream comprising gas with residual biological matter especially residual physiologically active waste such as pathogenic material entrained therein; (b) passing said output stream into a bath of molten aluminum.

The aluminum metal bath provides a long residence time for the secondary thermal treatment of the pyrolysis gases, as well as a chemically reactive medium which reduces residual physiologically active waste as well as organic compounds of physiological origin, typical pharmaceuticals, and metal-based tissue strains to hydrogen, hydrocarbons, carbon, nitrogen, etc. The gaseous byproducts from the molten aluminum treatment do not require filtration or scrubbing such as that which would normally be required for the effluents from single and multiple chamber incinerators and can, when containing economic amounts of combustible gases, e.g. hydrogen and hydrocarbons, be used for combustion, e.g. to provide heat energy.

DETAILED DESCRIPTION OF THE INVENTION

Figure 1:
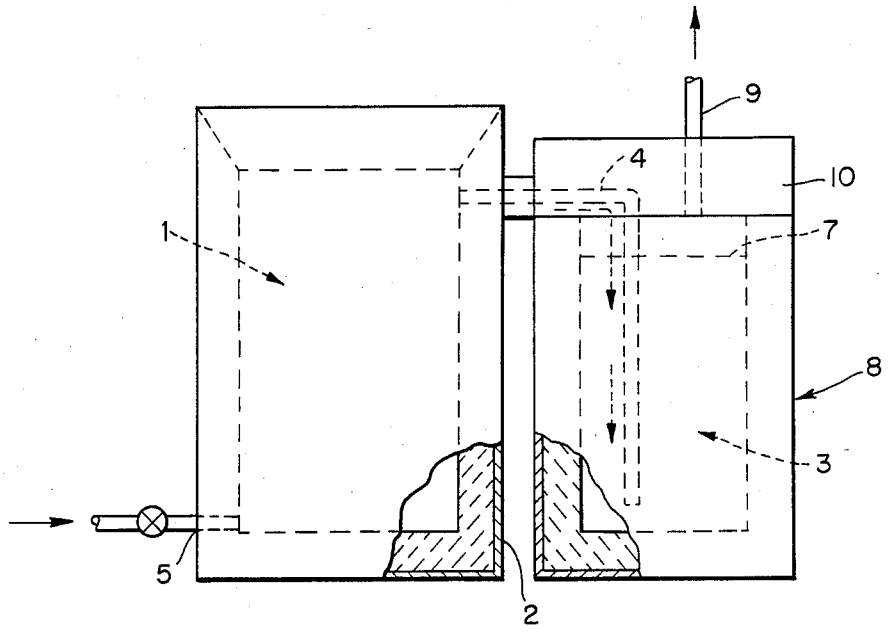
FIG. 1 schematically illustrates a system for carrying out the process herein.

As indicated above, heating of the waste products herein in closed chamber means is carried out to vaporize volatile materials and to pyrolyze residual organic non-volatiles.

The gas produced in the initial vaporization carries with it some solid and/or liquid biological material and is routed under pressure generated by the vaporization of the volatile materials into the bath of molten aluminum where the entrained solid and/or liquid biological material is reduced by the molten aluminum and is thus destroyed, along with the volatile components of the stream.

As heating in the closed chamber means continues, non-volatiles are pyrolyzed. The resulting off-gases, which can have biological wastes entrained therein are routed to the molten aluminum bath where said biological wastes are reduced by the molten aluminum and destroyed. When further heating results in no further vaporization the vapors remaining in the pyrolysis chamber may be swept into the molten aluminum by means of a stream of nitrogen or other inert gas.

Turning now in more detail to the heating step, the most volatile components in the waste being treated, e.g. chemicals used in treating pathological specimens such as ethyl alcohol and toluene, are flashed off. As heating continues and the temperature in the waste which is being treated increases, proteins coagulate and water vapor is formed from ruptured cells, saline solution and the fluids attendant to tissue specimens. Fats, oils and other organic compounds which are not water-soluble are steam distilled during this initial heating. On further heating, collagen proteins and any included higher molecular weight compounds and other non-volatile materials begin to decompose until the decomposition products become volatile. At the conclusion of the heating step, the residue remaining in the pyrolysis chamber consists primarily of carbon and metal salts, from tissues and from the decomposition of bone. When they are present with the tissue, cellulosic materials such as bandages and plastics decompose and volatilize at the appropriate temperatures. Water-soluble organic compounds such as pharmaceuticals, stains, and compounds being screened in such processes as the Ames test or toxicological feeding tests are either volatilized at low temperatures or degraded at higher temperatures, thereby becoming volatile. Viruses and enzymes, which are proteinaceous in character, are normally denatured as the temperature in the pyrolysis chamber increases. Proteinaceous materials within tissues, however, can be protected by the char of the tissue surrounding the protein and can remain viable as they pass out of the pyrolysis chamber in small particles entrained in the gases. Bacterial spores, which are particularly heat resistant, are likewise able under some circumstances, to exit the chamber in this way.

It has been discovered herein that physiologically active materials and organic compounds in gases from the heating, i.e. pyrolysis, chamber can be effectively treated by passage into molten aluminum. The invention described herein provides a method for treating pyrolysis gases at high temperatures under reducing conditions as well as modifications necessary to a pyrolysis chamber to make secondary treatment efficient and controllable.

The pyrolysis products of human and animal tissue, fermentation broths, bacterial cells, viruses, spores and toxins are further decomposed when bubbled through the bath of molten aluminum. The decomposed products react with the hot aluminum metal and are reduced to low molecular weight hydrocarbons, hydrogen, nitrogen, etc. Since all biological materials which can be volatilized in a pyrolysis chamber are composed, almost exclusively, of oxygen, carbon, hydrogen, nitrogen, sulfur, phosphorus and, on occasion, halogens, the resultant byproducts of the reaction with the aluminum are limited in number and character, regardless of the biological nature of the feed. For example, in addition to the gaseous reaction products set forth above, other products can include aluminum oxide and sulfide and on occasion carbides, nitrides, phosphides or phosphorus. Because the reactions are carried out under reducing conditions no water or carbon dioxide is formed or exhausted.

Effluent from the aluminum treatment can be vented to the atmosphere. In such case it is preferred to flare the combustible materials. In some cases, the effluent is preferably treated with conventional gas treatment systems prior to being vented to the atmosphere. It is preferred to recover the heating values from the combustible gases and in such case the combustible gases are routed to a burner for this purpose.

FIG. 1 schematically illustrates a system for carrying out the process herein. The system includes a normally closed chamber means in the form of a heating pyrolysis retort or chamber 1 which is a refractory-lined vessel enclosed in a gas-tight, preferably steel, encasement 2. Waste material to be treated is fed into the chamber 1 batchwise through a door or chute (not depicted) which is preferably fitted with gasketed doors or other means to prevent or minimize the entry of air. A second gasketed door (not depicted) is preferably fitted just above the level of the hearth for the removal of ashes. The chamber 1 can be heated by any conventional underfiring technique or, in the preferred embodiment, electrically. The chamber 1 is equipped with a valved line 5. The chamber 1 communicates with a refractory-lined vessel 8 containing an aluminum bath 3 having an upper surface 7 via a delivery tube 4 which receives exhaust from the top of the chamber 1 and vents to a point near the bottom of the aluminum bath 3. The tube 4 is readily made from a refractory material, although high temperature metal alloys are also satisfactory. An exhaust stack 9 emanates from the head space 10 above the molten aluminum, and may discharge directly to the out-of-doors, through a treatment system as required to meet local emissions regulations. In the preferred embodiment, the exhaust includes a flash arrester. The valved inlet 5 is provided to admit air or nitrogen and may be fitted with a vacuum release device to prevent back-syphoning.

In operation, the waste material is introduced into chamber 1 and the molten aluminum bath 3 is brought up to operating temperature. Temperatures for the molten aluminum can range from its melting point to its boiling point, i.e. from 660° C. to 2450° C., and are selected not only to provide reduction, but also to provide decomposition of thermally resistant and low reactivity materials. Since the maximum operating temperature in the secondary chamber of commercially available incinerators is approximately 1400° C., it can be seen that the molten aluminum bath is capable of providing as much or more heat than is available in the traditional processes.

When the aluminum in vessel 8 has reached its operating temperature, heat is applied to chamber 1 to raise the temperature in it to range from 600° C. to 850° C., preferably from 800° C. to 825° C. As the temperature in chamber 1 rises, vaporization and pyrolysis occur and the expansion and volatilization force vapor and materials entrained in it to leave chamber 1 by the tube 4 and ultimately pass into the molten aluminum bath 3, wherein reduction and secondary thermal treatment occurs and the treated materials are converted to innocuous compounds. Transfer of gases, vapors and solids from chamber 1 to bath 3 is preferably assisted by the introduction of nitrogen or other inert gas at line 5.

When the pyrolysis process is completed, the entry port can be reopened and the chamber 1 recharged. Alternatively, when all of the waste material has been destroyed, the heat may be turned off and the valve in line 5 opened to prevent back-syphoning as the chamber cools. It is advantageous to introduce nitrogen instead of room air into the chamber during cool-down to prevent flaring of any unburned material on the hearth and to provide an oxygen deficient atmosphere when the chamber is recharged.

The operation of this process in different mechanical configurations is apparent to those skilled in the art.

The following examples illustrate the practice of the invention without limitation thereof.

EXAMPLE I

A young rat weighing 205 grams is humanely sacrificed and placed in an 8 quart cast iron pot. The pot is sealed with a cast iron lid fitted with a copper wire gasket and secured by clamps. A transfer tube constructed of ¼ inch ID SS316 tubing connects the pot to a Dixon graphite crucible (size 16), approximately one-half filled with molten aluminum. A stainless steel exhaust tube fitted through a cover directs the gases from the head space above the aluminum to a glass cold finger trap immersed in a dry ice/acetone bath. The cast iron pyrolysis chamber is heated by two Meker burners. The crucible is heated by a gas flame in a melting furnace. The pyrolysis chamber is raised to a temperature of 600°–650° C. as measured by a thermister and the molten aluminum is maintained in the liquid state throughout. After 30 minutes, the heat is turned off and the lid removed from the pot. After an additional 15 minutes, the cold finger trap is removed and the condensate is quantitatively removed to a tared glass vessel and weighed. The liquid is then analyzed for total organic carbon (TOC); less than 2 parts per million TOC is found.

EXAMPLE II

Using the apparatus as described in Example I, three plastic petri dishes containing cultures of *Bacillus stearothermophilis* are introduced into the pyrolysis chamber and the temperature raised to a surface temperature reading of 800° C. The cold finger trap is replaced by a Matsson-Garvin slit to agar sampler timed to complete one revolution in 60 minutes. At the completion of the cycle, the agar plate from the slit to agar sample is covered and removed to an incubator. After 72 hours at 37° C., no growth is seen on the plate.

EXAMPLE III

Five grams of α-naphthylamine (a suspected carcinogen) is placed on 3 agar filled petri dishes containing a Salmonella culture to simulate an Ames test and introduced into the pyrolysis chamber, as described in Example II. The slit to agar sampler is replaced by a glass T-tube with a serum cap on one end. During the treatment, 100 micro liter aliquots are removed via a gas-tight syringe at 15 minute intervals. The aliquots are injected into a gas chromatograph fitted with a flame ionization detector. Substantially no bacteria or α-naphthylamine is detected; acetylene is present at less than 50 parts per million. The ash in the pyrolysis chamber is collected, slurried in a minimal amount of carbon disulfide, filtered, concentrated by bubbling nitrogen gas through the carbon disulfide in a test tube and analyzed by gas chromatography. Substantially no bacteria or α-naphthylamine is detectable in the extract.

EXAMPLE IV

A plastic 3 mil. thick bag with a volume of 1 quart is half-filled with cotton bandages and a cotton hand towel. Ten 1 cc plastic Tuberculin syringes are filled from a fermentation broth containing approximately $5\times10^4$ spores (B. subtilis) per liter, their contents injected into the bandages, and the syringe dropped into the bag. An additional 10 cc of broth is carefully poured onto the bandages and towel and the bag is tied with a wire utilizing apparatus as described in Example II. The bag is introduced into the iron pot and the destruction process is performed with sampling as described in Example II. After three experiments the plates from the slit to agar sampler average fewer than 1 colony per plate. The contents of the pot, after cooling, are washed out with 100 ml of sterile water, filtered through coarse cloth, streaked on Tripticase Soy agar plates and incubated at 37° C. for 72 hours. The plates from the extraction of the ash contain 5–10 colonies per plate.

While the foregoing describes perferred embodiments, modifications within the scope of the invention will be evident to those skilled in the art. Thus, the scope of the invention is intended to be defined by the claims.

What is claimed is:

1. A process for the destruction of biological waste products comprising the steps of (a) heating said waste products in a sealed chamber to vaporize volatiles and to pyrolyze non-volatiles and producing an output stream comprising gas with residual biological matter including physiologically active materials entrained therein, followed by (b) treating said output stream after removal from said sealed chamber by passage into contact with molten aluminum thereby effecting chemical reduction by reaction with aluminum and producing innocuous effluent.

2. Process as described in claim 1 wherein the waste products comprise tissue from a mammal.

3. Process as described in claim 1 wherein the waste products comprise biological fluids.

4. Process as described in claim 1 wherein the waste products comprise infectious bacteria or their spores.

5. Process as described in claim 1 wherein the waste products contain carcinogenic agents.

* * * * *